US011511296B2

(12) United States Patent
Lehtonen et al.

(10) Patent No.: US 11,511,296 B2
(45) Date of Patent: Nov. 29, 2022

(54) NOZZLE, NOZZLE ARRANGEMENT AND LIQUID DISTRIBUTION SYSTEM

(71) Applicant: METABAR TECHNOLOGY OY, Nokia (FI)

(72) Inventors: Jarmo Lehtonen, Sarvvik (FI); Seppo Nissilä, Oulu (FI)

(73) Assignee: METABAR TECHNOLOGY OY, Nokia (FI)

( * ) Notice: Subject to any disclaimer, the term of this patent is extended or adjusted under 35 U.S.C. 154(b) by 564 days.

(21) Appl. No.: 16/487,452

(22) PCT Filed: Feb. 20, 2018

(86) PCT No.: PCT/FI2018/050123
§ 371 (c)(1),
(2) Date: Aug. 21, 2019

(87) PCT Pub. No.: WO2018/154180
PCT Pub. Date: Aug. 30, 2018

(65) Prior Publication Data

US 2020/0055065 A1 Feb. 20, 2020

(30) Foreign Application Priority Data

Feb. 21, 2017 (FI) ..... 20175158

(51) Int. Cl.
*B05B 7/06* (2006.01)
*E03C 1/046* (2006.01)
(Continued)

(52) U.S. Cl.
CPC ..... *B05B 7/066* (2013.01); *E03C 1/046* (2013.01); *E03C 1/048* (2013.01); *E03C 1/057* (2013.01); *E03C 1/18* (2013.01)

(58) Field of Classification Search
CPC ..... B05B 7/066; E03C 1/046; E03C 1/048; E03C 1/057; E03C 1/18
See application file for complete search history.

(56) References Cited

U.S. PATENT DOCUMENTS 2,516,401 A * 7/1950 Marcuse ..... B05B 7/064 239/536
3,918,987 A 11/1975 Kopfer
(Continued)

FOREIGN PATENT DOCUMENTS

CN 103822008 A 5/2014
CN 104790470 B 7/2016
(Continued)

OTHER PUBLICATIONS

Japanese Notice of Reasons, Application No. 2019-565987, dated Jan. 21, 2022.
(Continued)

*Primary Examiner* — Justin M Jonaitis
(74) *Attorney, Agent, or Firm* — MacMillan, Sobanski & Todd, LLC

(57) ABSTRACT

The invention relates to Nozzle, comprising a liquid inlet channel (LIN) for water or other liquid, the liquid inlet channel having an exit mouth (LINM) for letting liquid out from the liquid inlet channel, a pressurized air inlet channel (AIN) having an exit mouth (AINM) for letting pressurized air out from the pressurized air inlet channel (AIN). In the invention the liquid inlet channel (LIN) and pressurized air inlet channel (AIN) are positioned in such way that the pressurized air inlet channel (AIN) at least partially surrounds the liquid inlet channel (LIN) so as to create mist from exiting liquid and exiting pressurized air.

19 Claims, 11 Drawing Sheets

(51) Int. Cl.

| | |
|---|---|
| ***E03C 1/048*** | (2006.01) |
| ***E03C 1/05*** | (2006.01) |
| ***E03C 1/18*** | (2006.01) |

(56) References Cited

U.S. PATENT DOCUMENTS

| | | | | |
|---|---|---|---|---|
| 3,965,494 | A | 6/1976 | Baker | |
| 5,702,115 | A | 12/1997 | Pool | |
| 5,884,846 | A * | 3/1999 | Tan | B05B 7/066 239/338 |
| 6,173,458 | B1 | 1/2001 | Maddux | |
| 7,451,941 | B2 * | 11/2008 | Jackson | B08B 1/00 239/419 |
| 8,348,174 | B2 * | 1/2013 | Baker | B05B 1/18 239/419 |
| 9,173,809 | B2 * | 11/2015 | Honeyands | A61H 33/028 |
| 10,471,448 | B2 | 11/2019 | Markus | |
| 2002/0179737 | A1 * | 12/2002 | Ryser | B05B 7/12 239/418 |
| 2002/0198564 | A1 * | 12/2002 | Pichon | A61B 17/00491 604/82 |
| 2003/0019031 | A1 | 1/2003 | Mosis | |
| 2005/0139239 | A1 | 6/2005 | Prae | |
| 2005/0202156 | A1 * | 9/2005 | O'Connor | B05B 7/066 427/2.1 |
| 2008/0230053 | A1 * | 9/2008 | Kraft | A61M 11/06 128/200.14 |
| 2012/0285033 | A1 | 11/2012 | Hsu | |
| 2014/0053332 | A1 | 2/2014 | Cole | |

FOREIGN PATENT DOCUMENTS

| | | | |
|---|---|---|---|
| DE | 19714071 | A1 | 10/1988 |
| DE | 202007003204 | U1 | 7/2007 |
| DK | 201170105 | A | 3/2011 |
| EP | 2492018 | A1 | 8/2012 |
| JP | S58150456 | A | 9/1983 |
| JP | 63115457 | U | 7/1998 |
| JP | 2000246152 | A | 9/2000 |
| JP | 200380178 | A | 3/2003 |
| JP | 2005103366 | A | 4/2005 |
| JP | 3165523 | U | 1/2011 |
| KR | 101257637 | B1 | 5/2013 |
| WO | 2012030216 | A1 | 3/2012 |
| WO | 2016055116 | A1 | 4/2016 |

OTHER PUBLICATIONS

Chinese Rejection Decision; Rebuttal, Application No. 201880026227.X, dated Mar. 15, 2022.

Industry 4.0 3D Printing, (edited by the Nikkei Manufacturing Editorial Department in Japan; translated by Lu Shi et al.) Beijing: Oriental Publishing House, Apr. 2016, pp. 171-172.

* cited by examiner

NOZZLE, NOZZLE ARRANGEMENT AND LIQUID DISTRIBUTION SYSTEM

PRIORITY

This application is a U.S. national application of the international application number PCT/FI2018/050123 filed on Feb. 20, 2018 and claiming priority of Finnish national application FI20175158 filed on Feb. 21, 2017 the contents of both of which are incorporated herein by reference.

FIELD OF THE INVENTION

The present invention relates nozzles that can be used for example in water delivery taps/faucets and in other liquid delivery i.e. distribution components and systems.

Water taps/faucets are used not only in private homes but also in offices, restaurants other facilities, just to name a few. The water tap may be installed in kitchen, lavatory space, bathroom, garden etc.

A water delivery system or other liquid delivery systems is a combination of elements that include not only the nozzle and associated tap/faucet but also the other elements that are needed for feeding the nozzle with liquid and air.

Some examples of prior known water tap nozzles are known from CN103822008A, US20140053332A.

One of the disadvantages associated with the above mentioned technology relates to lacking ability to produce an efficient but liquid saving mist from the inputted air and liquid. Another aspect of the existing nozzles and nozzle containing systems is that the structures thereof can be too sophisticated so therefore they can be expensive to be manufactured.

BACKGROUND OF THE INVENTION

Brief Description [Disclosure] of the Invention

An object of the present invention to provide a nozzle and liquid delivery system so as to solve or alleviate the above mentioned disadvantages. The objects of the invention are achieved by a nozzle and system which are characterized by what is stated in the independent claims. The preferred embodiments of the invention are disclosed in the dependent claims.

The invention is based on the idea of appropriate location of the liquid tube in relation to air tube, and vice versa.

One advantage of the inventive nozzle and system is that it is possible to create a good enough mist with a simple and robust structure and without using excessive amount of liquid.

BRIEF DESCRIPTION OF THE DRAWINGS

In the following the invention will be described in greater detail by means of preferred embodiments with reference to the attached [accompanying] drawings, in which.

DETAILED DESCRIPTION OF THE INVENTION

Figure 1:
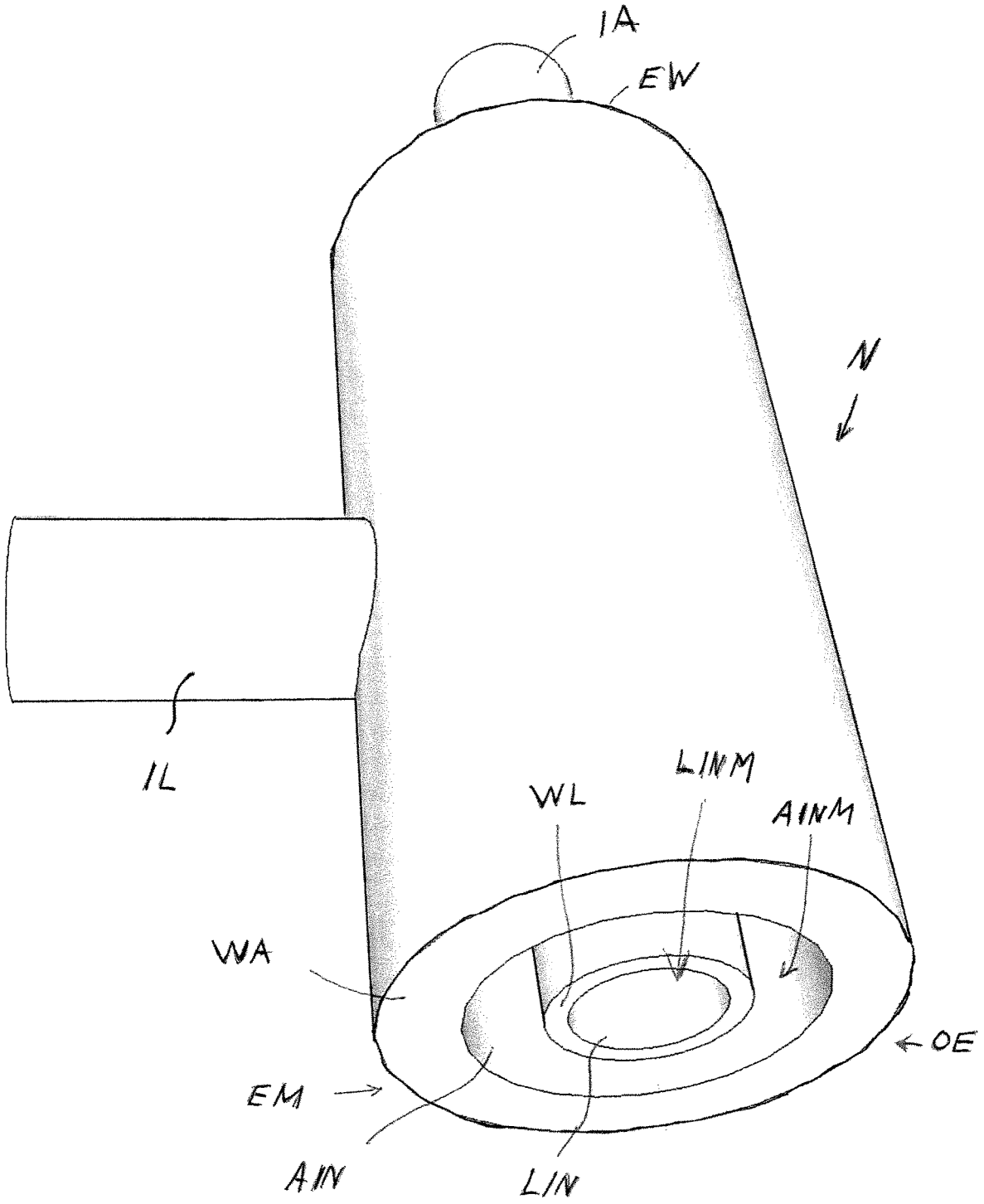
FIG. 1 is shows a nozzle.
Figure 2:
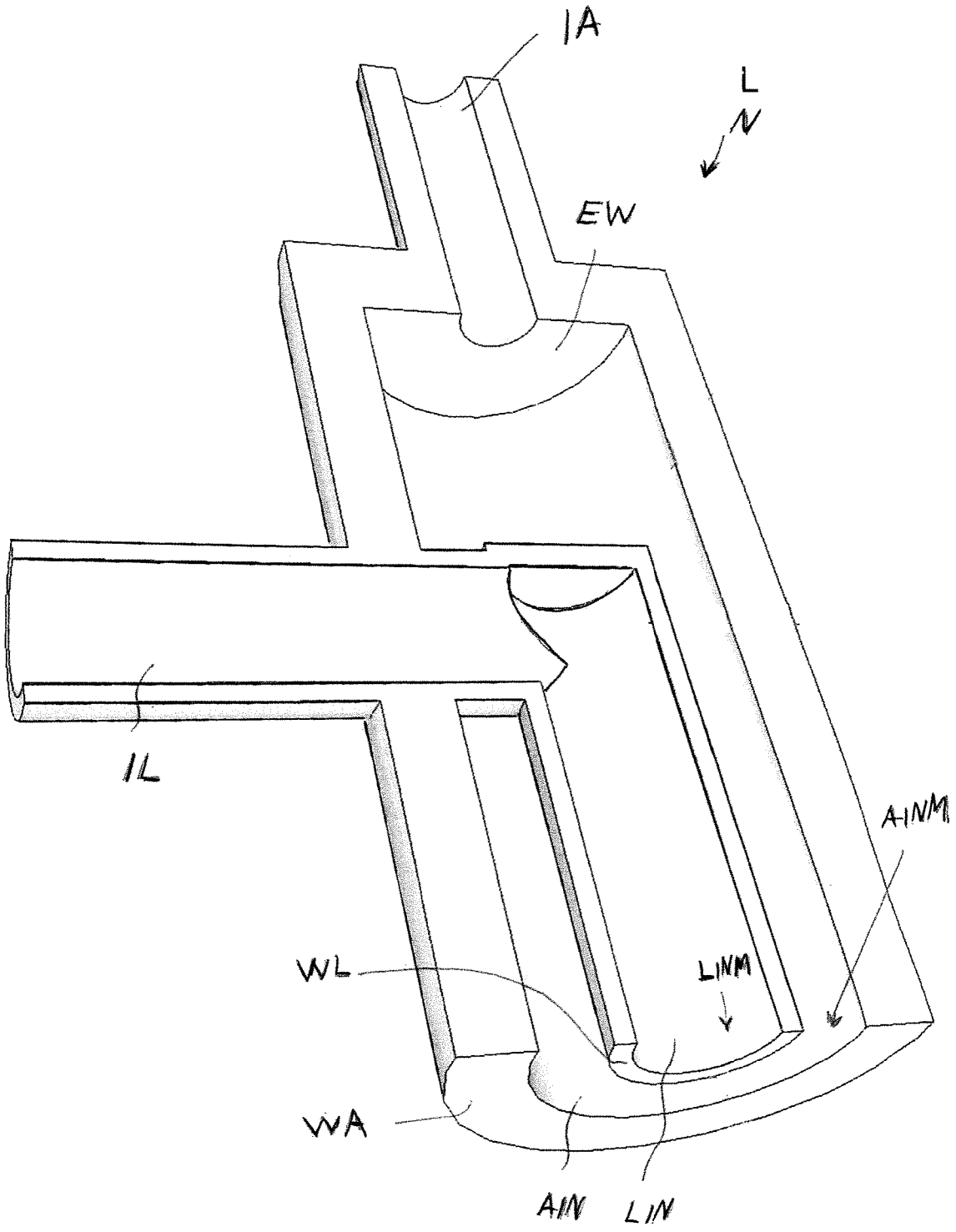
FIG. 2 is a cut away figure showing the internal structure of a nozzle of FIG. 1.

Referring to FIGS. 1-2, there is shown a nozzle N, comprising a liquid inlet channel LIN for water or other liquid. The liquid inlet channel LIN has exit mouth LINM for letting liquid out from the liquid inlet channel LIN. In an embodiment, the nozzle is a nozzle of a water tap/faucet.

Additionally, the nozzle N comprises a pressurized air inlet channel AIN, so an inlet channel AIN for pressurized air. The inlet channel AIN for pressurized air has an exit mouth AINM for letting pressurized air out from the pressurized air inlet channel AIN. Air is used here as an example gas. It is clear that other pressurized gases will work similar as pressurized air. For example carbon dioxide, CO2, could be used in some applications. Air is regarded as a gaseous substance.

The exit mouth LINM for letting liquid out from the liquid inlet channel LIN and the exit mouth AINM for letting pressurized air out from the pressurized air inlet channel AIN together form the exit mouth of the nozzle N at the output end OE of the nozzle N.

The input end IE of the nozzle comprises input IL for inputting the liquid and input IA for inputting the pressurized air.

In an embodiment, one or more of the following is made from tube: the inlet channel LIN for liquid, the inlet channel AIN for the pressurized air, the input IL for inputting the liquid to liquids channel LIN, the input IA for inputting the pressurized air to air inlet channel AIN.

At the input end IE of the nozzle N, the outer tube so in other words the inlet channel AIN for pressurized air comprises end wall EW whereto the air input IA is attached so as to make it possible to input air to the internal space defined by the wall WA of the air inlet channel AIN. The wall WA and end wall EW together make the inlet channel AIN to be like a small chamber with on open end (the exit mouth AINM) at the exit mouth EM of the nozzle N. In some embodiments the chamber does not need to be any extended space, so it is possible that input IA has the same size as air inlet AIN. In an embodiment input IA can be larger than air inlet AIN. Particular end wall EW is not needed when input IA and tube formed by wall WA belong to same continuous tube.

The nozzle N can be made from an appropriate material such as steel, stainless steel, titanium, brass, bronze, silver, gold, vinyl, ABS (acrylonitrile-butabiene styrene), PLA (polylactide) plastic.

The nozzle can be manufactured by casting/molding or alternatively by welding or otherwise combining from tubes. Furthermore, especially the 3D printing method is suitable. 3D printing process gives practical advantages to manufacture the whole nozzle at one process phase, with simple and effective structures. It also enables compact structure of multiple nozzles.

The internal space within the liquid inlet channel LIN is defined by the wall WL of the liquid inlet channel LIN. Likewise, internal space within the inlet channel AIN for the pressurized air is defined by wall WA of the inlet channel AIN for the pressurized air.

Figure 9:
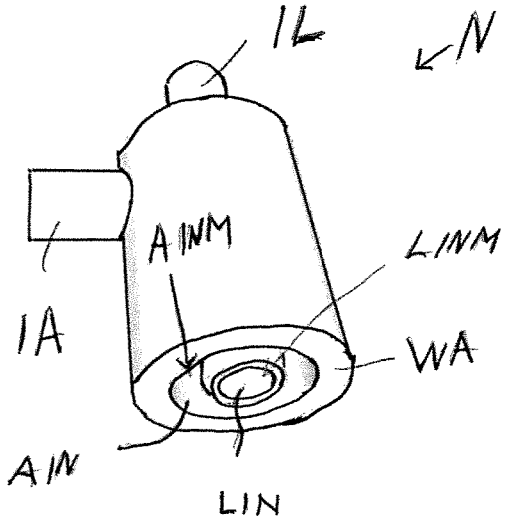
FIG. 9 shows a nozzle with mirror-like inputs compared to FIG. 1.
Figure 10:
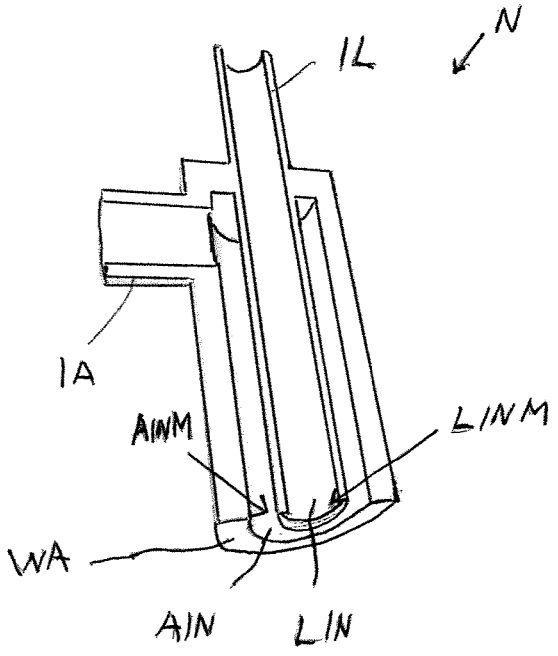
FIG. 10 is a cut away figure showing the internal structure of a nozzle of FIG. 9.

FIGS. 9-10 relate to alternative embodiment of the nozzle NN with mirror-like input structures compared to FIGS. 1-2. In FIGS. 9-10 the input IL is at the end and it brings liquid straight through the nozzle NN to liquid inlet LIN, whereas input IA brings air from the side of the nozzle NN to air inlet AIN. The nozzle arrangement of FIG. 6 uses nozzles as shown in FIGS. 9-10 because air is connected to the side of the nozzles and the liquid (like water) is connected to the input end of the nozzles.

Liquid for liquid channel LIN can be water, heated water, soap, disinfection liquid, coloring liquid or water with washing detergents. Air for air channel AIN can be ambient air, filtered air, specific air component such as carbon dioxide CO2, nitrogen N2, oxygen O2 or their combination.

Figure 6:
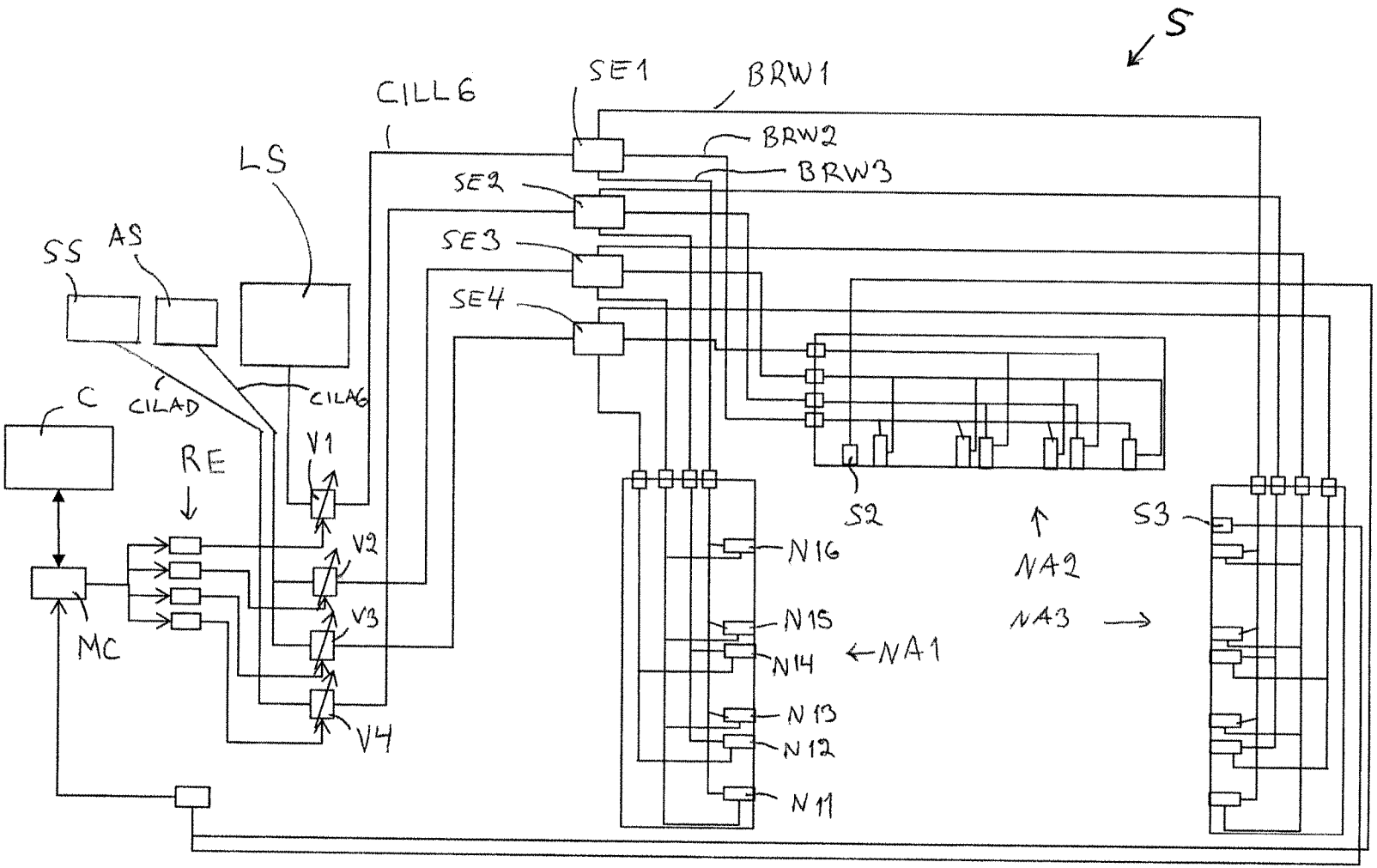
FIG. 6 shows a system with three nozzle arrangements.
Figure 7:
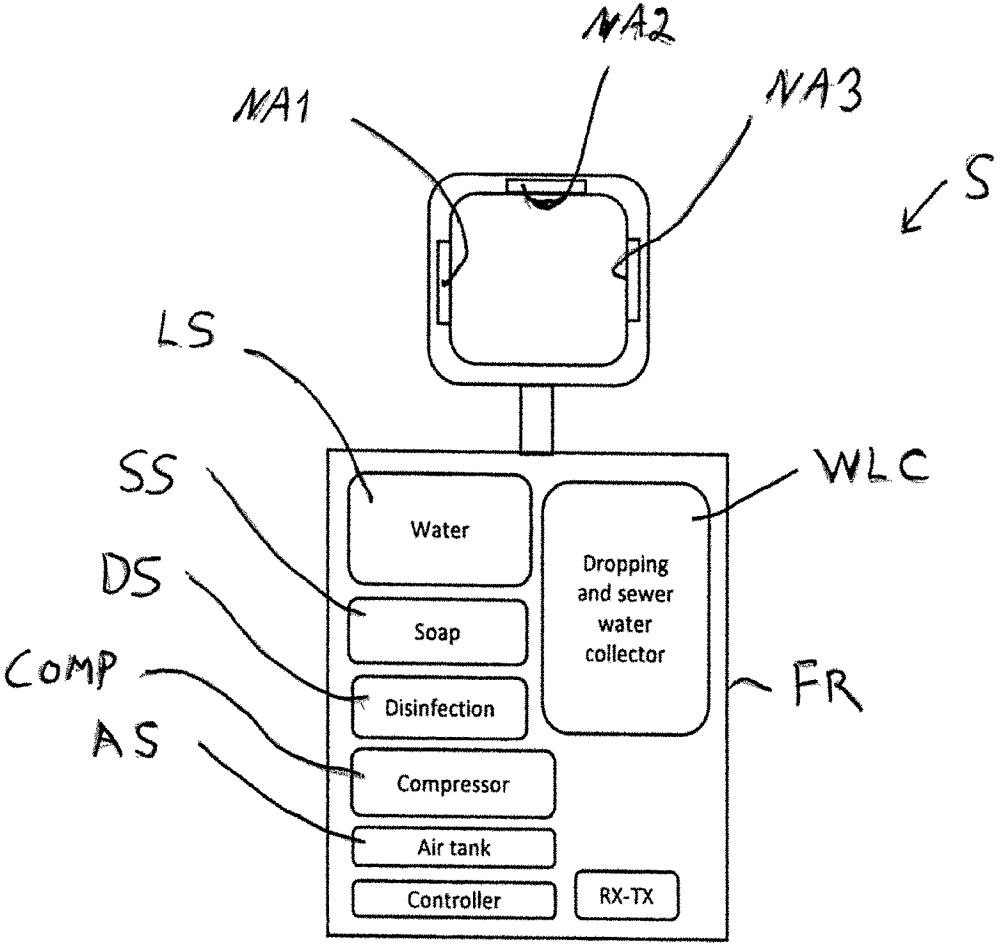
FIG. 7 shows a mobile liquid distribution system/station.

In FIGS. 6-7, the system comprises a liquid source LS water, or an interface for receiving water.

Referring to FIGS. 6-7, air source is an external (outside the system/arrangement) or internal (within the system/arrangement) air compressor COMP or an air tank or other air container AS connectable to air compressor COMP, or any high flow air generator as an air source AS. Air pressure is preferably 3-8 bars. Referring to other kind of sources, in addition to liquid (water) source LS and air source AS, the system comprises a source SS of additional liquid such as soap, as can be seen in FIGS. 6-7. Furthermore, there can be a yet another source, so source DS for disinfectioning liquid, like the one shown in FIG. 7. Source DS for disinfectioning liquid can have similar connections like liquid source LS or additional liquid source SS. Some of the nozzles can be connected to liquid source LS or additional liquid source SS, and some other nozzles to said source DS for disinfectioning liquid.

Figure 3:
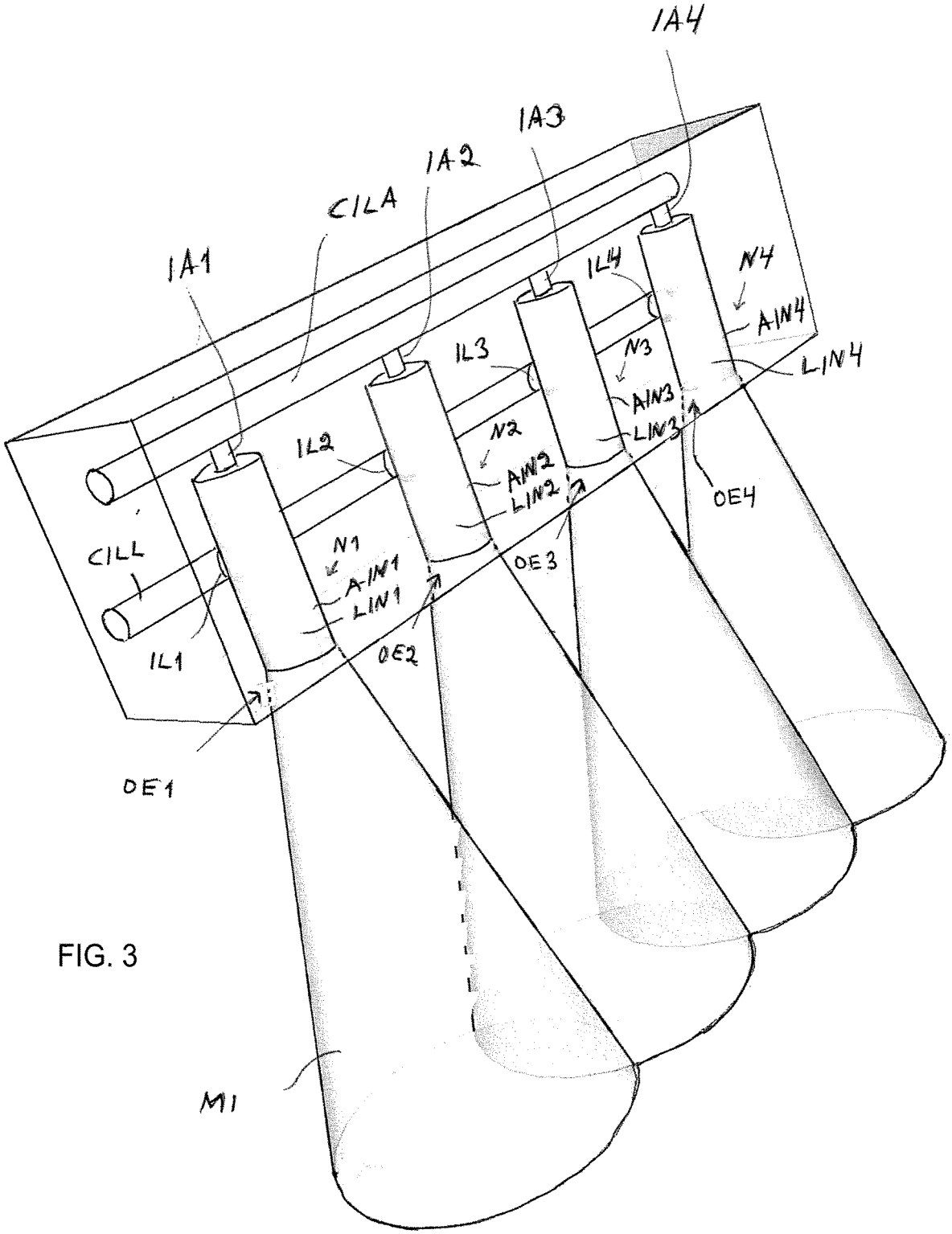
FIG. 3 shows a nozzle arrangement with four nozzles
Figure 4:
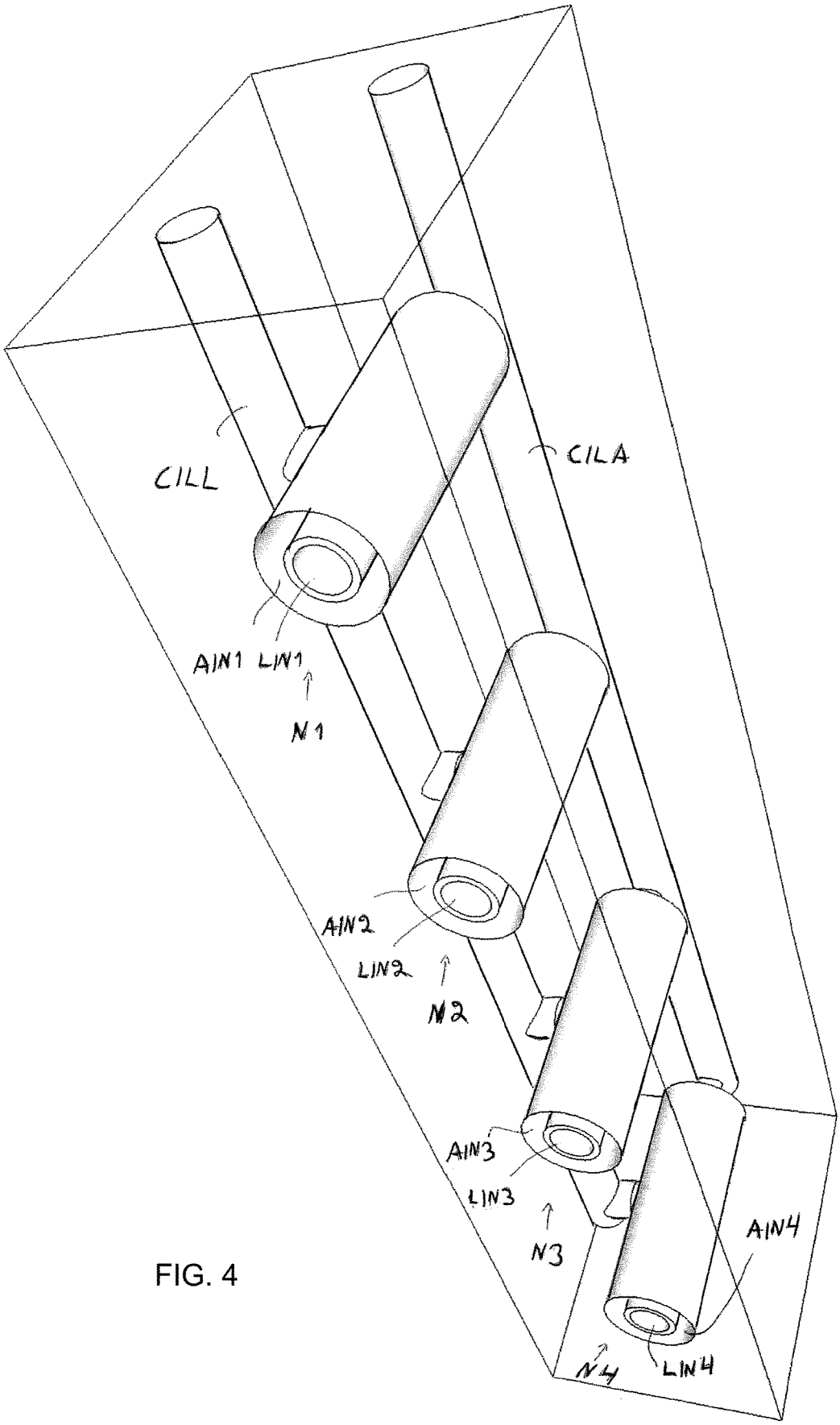
FIG. 4 shows a nozzle arrangement of FIG. 3 but showing also the produced liquid/air-mist from exiting from each nozzle.
Figure 5:
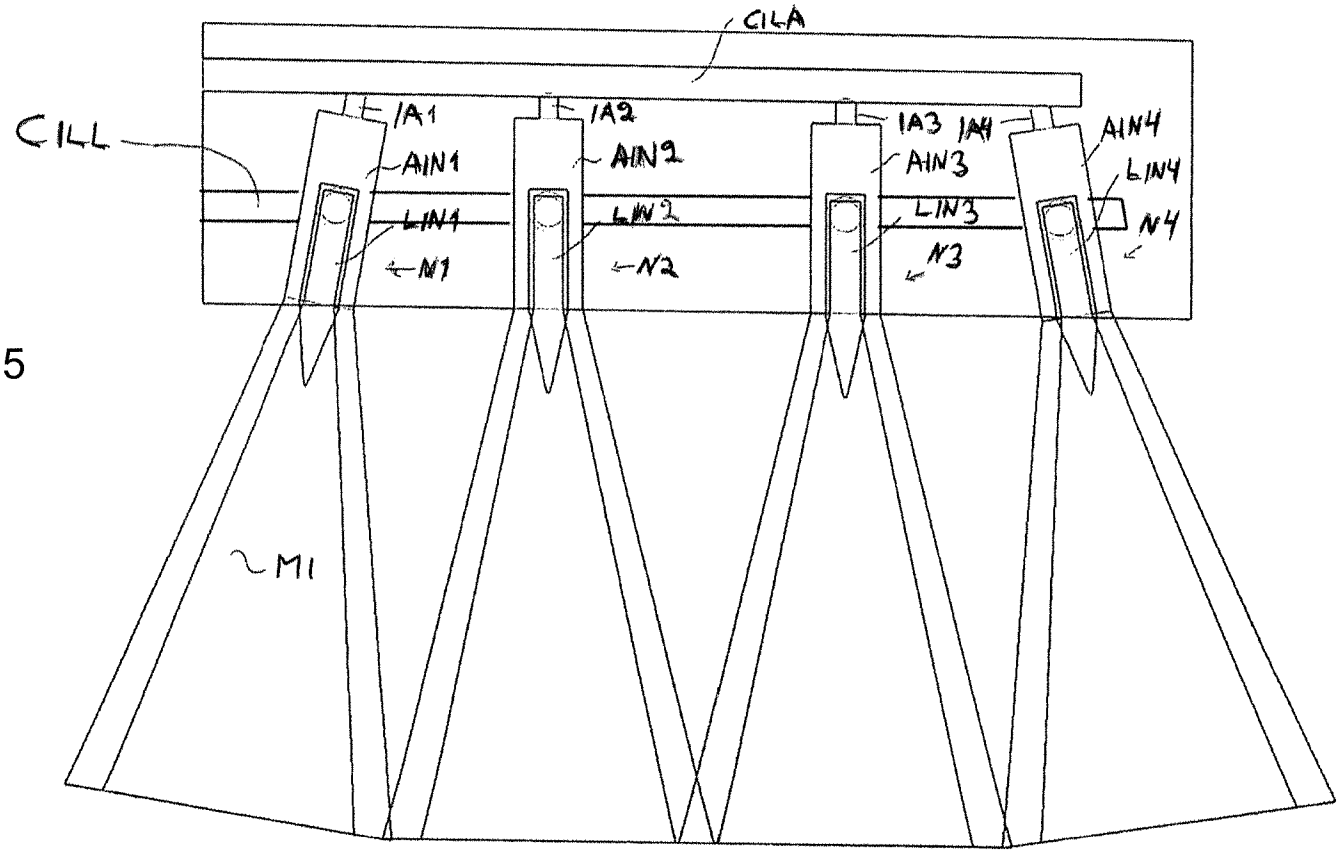
FIG. 5 shows a modified version of the nozzle arrangement, with inclined nozzles at the outer edges.

FIGS. 3-5 relate to nozzle arrangement, with several such as four nozzles N1-N4. In FIGS. 3-5 the arrangement has similar kind of structures as was disclosed above for the nozzle N of FIGS. 1-2. Generally speaking, two or more nozzles can be combined to form a line of nozzles. Instead of line of nozzles, the nozzle arrangement can have matrix-form, such as 2×2 matrix having four nozzles.

Regarding nozzles N1-N4, in FIGS. 3-5 we can see liquid inlet channels LIN1-LIN4, air inlet channels AIN1-AIN4 for pressurized air, exit mouths LINM1-LINM4 for letting liquid out from the liquid inlet channels LIN1-LIN4, exit mouths AINM1-AINM4 for letting pressurized air out from the pressurized air inlet channels AIN1-AIN4, output ends OE1-OE4 of the nozzles N1-N4, inputs IL1-IL4 for inputting the liquid to liquid channels LIN1-LIN4, inputs IA1-IA4 for inputting the pressurized air to air inlet channels AIN1-AIN4.

In FIG. 6, there are multiple nozzle arrangements NA1-NA3, such as three nozzle arrangements, each having one or more nozzles such as six nozzles N11-N16 as is shown for nozzle arrangement NA1.

In FIGS. 3-5 and 6, the arrangement, especially the common input line CILL (CILL6 in FIG. 6) for liquid such as water and common input line CILA (CILA6 in FIG. 6) for pressurized air and common input line CILAD for additive such as soap are equipped with control valves V1-V4 (shown in FIG. 6). Valve V1 is arranged to control (open/close) the liquid flow in water input line CILL6 (CILL in FIGS. 3-5), valves V2 and V3 are arranged to control the flow of pressurized air in sub lines of air input line CILA6 (CILA in FIGS. 3-5). Valve V4 is arranged to control the flow of additive liquid in additive liquid input line CILAD6 of FIG. 6.

Valves V1-V4 can be manually or electrically operated. Valves V1 and V4 are for selecting which one of the two liquids (water, additive such as soap) is fed to the liquid inlet channel LIN of each nozzle. In case or nozzle arrangement of FIGS. 3-5, the uses of valves V1, V4 of FIG. 6 selects which liquid (water, soap) is fed to common input line CILL for liquid input.

Also, there is a splitter-elements SE1-SE4 for splitting each of the common input lines CILL/CILL6, CILA6 (having two sub lines) and, CILAD to several branches such as to three separate branches because the system comprises three different nozzle arrangements. For example, splitter element SE1 splits the liquid input line CILL6 in FIG. 6 to three branches BRW1-BRW3. Branch BRW1 is connected to nozzle arrangement NA1, branch BRW2 is connected to nozzle arrangement NA2 and branch BRW3 is connected to nozzle arrangement NA3.

Referring to nozzle arrangement NA1 in FIG. 6, nozzles N11, N13, N15 and N16 are connected to air feed and to water feed. Nozzles N12 and N14 are connected to air feed and to additive (such as soap) feed.

In FIGS. 6-7, the system S also comprises a microcontroller MC that controls the operation of the valves V1-V4 of FIG. 6 via relays RE, and the microcontroller MC is in wired or wireless communication with a computer C such as a laptop computer. Microcontroller MC also controls that nozzles NA11-N16 (or N1-N4) operate in a desired sequence. Microcontroller MC delivers the control-operation by switching the valves in a certain order.

The nozzle arrangements NA2, NA3 comprise one or more sensors S2, S3 that are connected to microcontroller MC. One or more sensors S2, S3 are arranged for detecting when user's hand is set in the washing area/space. i.e the sensor detects if the hand is set/inserted inside the washing area/space, so it starts the washing sequence because the controller MC is arranged to control (now opening) one or more of the valves V1-V4 of FIG. 6. When the hand is taken away from the washing area/space, the washing process will stop, because of the controller MC, having input from one or more sensors S2, S3, controlling (now closing) one or more of the valves V1-V4.

In FIGS. 1-2, regarding the nozzle N, the liquid inlet channel LIN and pressurized air inlet channel AIN are positioned in such way that the pressurized air inlet channel AIN surrounds the liquid inlet channel LIN. The purpose is to create mist MI from the liquid and pressurized air. The same structural principle is true also for the nozzles N1-N4 in FIGS. 3-5, and for nozzle NN of FIGS. 9-10. The air flow exiting from exit mouth AINM causes suction to liquid inlet channel LIN and to exit mouth LINM thereof. The suction draws liquid (such as water) from the exit mouth LIMN of the channel LIN, provided that the valve V1 in FIG. 6 is open so that liquid can flow. The air from exit mouth AINM and liquid from exit mouth LINM are mixed and the mist is thereby formed.

Inputted air flows out from the outer tube/pipe AIN, the air flow mixes air and liquid from the inner pipe/tube LIN.

An advantage of this arrangement is that a non-pressurized liquid sources LS, SS, DS can be used, such as a water tank LS or container, soap container SS or disinfection liquid container DS. Liquid source is not needed to be pressurized. The mist quality and quantity is not dependent on the pressurized liquid but can be controlled only with air pressure and flow.

However, to enhance mist amount, it is also possible to use pressurized liquid to be fed in liquid channel LIN.

In the event the pressurized air flow is in decisive role so high enough, then the air flow in outer tube AIN creates a forcing effect so it draws liquid from the inner pipe/tube LIN to join with the air flow.

When liquid flow is allowed to flow, the liquid will be mixed with the air flow and as a result a mist MI is formed/created.

In order to have even better forming of mist, the nozzle N and the related nozzle arrangement with nozzles is such that in an embodiment liquid inlet channel LIN is coaxial with the pressurized air inlet channel AIN. Therefore, in an embodiment, the liquid inlet channel LIN is positioned in such way that at least at the exit mouths LINM, AINM of the liquid inlet channel LIN and the pressurized air inlet channel AIM, the liquid inlet channel LIN shares the same central point with pressurized air inlet channel AIN.

Another feature for forming the mist in even a better is according to an embodiment where the exit mouth LINM of the liquid inlet channel LIN and the exit mouth AINM of the pressurized air inlet channel AIN extend in such way that they are substantially in the same plane. This means that at output end OE, the exit mouth LINM for liquid extend as far as the exit mouth AINM.

The applicant has found out that the sizes of the inlet channels LIN and AIM are important. In an embodiment, the transversal cross-sectional area of the flow space within the liquid inlet channel LIN is less than 75% of the transversal cross sectional area of the flow space within the pressurized air inlet channel. To be more specific, the most important area is the exit mouth area, so in an embodiment the structure is such that at the exit mouth of the liquid inlet channel, the transversal cross-sectional area of the flow space within the liquid inlet channel is less than 75% of the transversal cross sectional area of the flow space within the pressurized air inlet channel, at the mouth of the pressurized air inlet channel.

In an embodiment, the nozzle dimension for inner tube/pipe so for liquid channel LIN is 0.2-1.0 mm2, which is the transversal area within the liquid inlet channel LIN.

Furthermore, in an embodiment, nozzle dimension for outer tube/pipe so for air inlet channel AIN is 1-2 mm2, which is the transversal area within the air inlet channel AIN.

In an embodiment, the transversal area within the liquid inlet channel LIN is 0.6 mm2 and the transversal area within the air inlet channel AIN is 1.3 mm2.

In an embodiment, the thickness of the wall WL of the liquid inlet channel LIN is less than 0.30 mm, this is important so that the air flow and the liquid flow are not too far away from each other, because too long distance creates difficulties for forming the mist from water and pressurized air.

Referring especially to FIGS. 6-8 and 11-12, another aspect of the invention relates to a larger system, namely a liquid distribution system S, comprising, in addition to said one or more nozzles, N, N11-N16, a liquid source LS, or at least an interface for connecting to an external liquid source such as water tubing network of the building where the systems is used. If the liquid source LS is comprised by the system itself, then the liquid source LS can be a liquid container LS such as a water container. Additionally, the system S comprises a source AS of pressurized air or at least an interface for connecting to an external air source of pressurized air, such a source AS can be an air compressor or an air tank connectable to a compressor.

The system can also comprise another container SS that can be used for another liquid than water, especially for soap. Both sources of liquid LS, SS so containers LS and SS are connected to liquid inlet channel LIN so that they can feed liquid to liquid inlet channel LIN.

Regarding liquid inputs, the system S can comprise different nozzle arrangements, with different inputs/feed, such as for water, soap, disinfectioner, colouring liquid.

Referring to FIGS. 6-7, the system S comprises nozzle arrangements NA1-NA3. Especially referring to FIG. 7, in an embodiment the liquid distribution system is an independent mobile unit as a washing stand frame FR, containing said liquid source LS and said source AS of pressurized air and also source SS of additional liquid such as soap and yet another source DS of yet another liquid such as disinfectioner liquid. Additionally, there is compressor COMP and controller MC and a waste water (droplets, and/or condensing water) collecting container WLC. In FIG. 7, the unit also comprises a wireless communications device RX-TX, for communication and control purposes.

The liquid source LS is connected to liquid inlet channel LIN of FIGS. 3-5 via input line CILL (FIGS. 3-5) and CILL6 (FIG. 6), and the source AS of pressurized air is connected to pressurized air inlet channel AIN of FIGS. 3-5 via air input line CILA (FIGS. 3-5) and CILA6 (FIG. 6).

There are three main versions. In the first version, the liquid distribution system S contains said waste liquid container WLC (so no interface for external sewage network) but the inputting of liquid and pressurized air to nozzles is arranged via said interfaces for liquid and air.

In the second version, the system S contains said waste liquid container WLS and said liquid source LS but the inputting of pressurized air to nozzles is arranged via said interface for air.

In the third and most mobile version, the liquid distribution system is an independent mobile unit, containing said liquid source LS and said source AS of pressurized air and said waste liquid container WLC.

Regarding the role of the waste water container, most of the water in the mist is vapourized to open (ambient) air but the waste liquid container WLC can collect the rest. In an embodiment most of the water is vapourized to ambient air, and the advantage of this is that waste water is not formed and any traditional collecting of waste water or rinsing water is not needed. This makes possible to make a washing stand FR which does not need any fixed sewage-connection. Waste liquid container/collector WLC is designed to locate at a lower part of washing frame FR of FIGS. 7-8.

Regarding the operation of the system, the system comprises controller such as valves V1 or other controller to close the flow of the liquid inlet channel LIN, so as to stop the creation of mist and so as to replace the mist with a drying air flow, if either one of the air valves V2-V3 is open.

Figure 11:
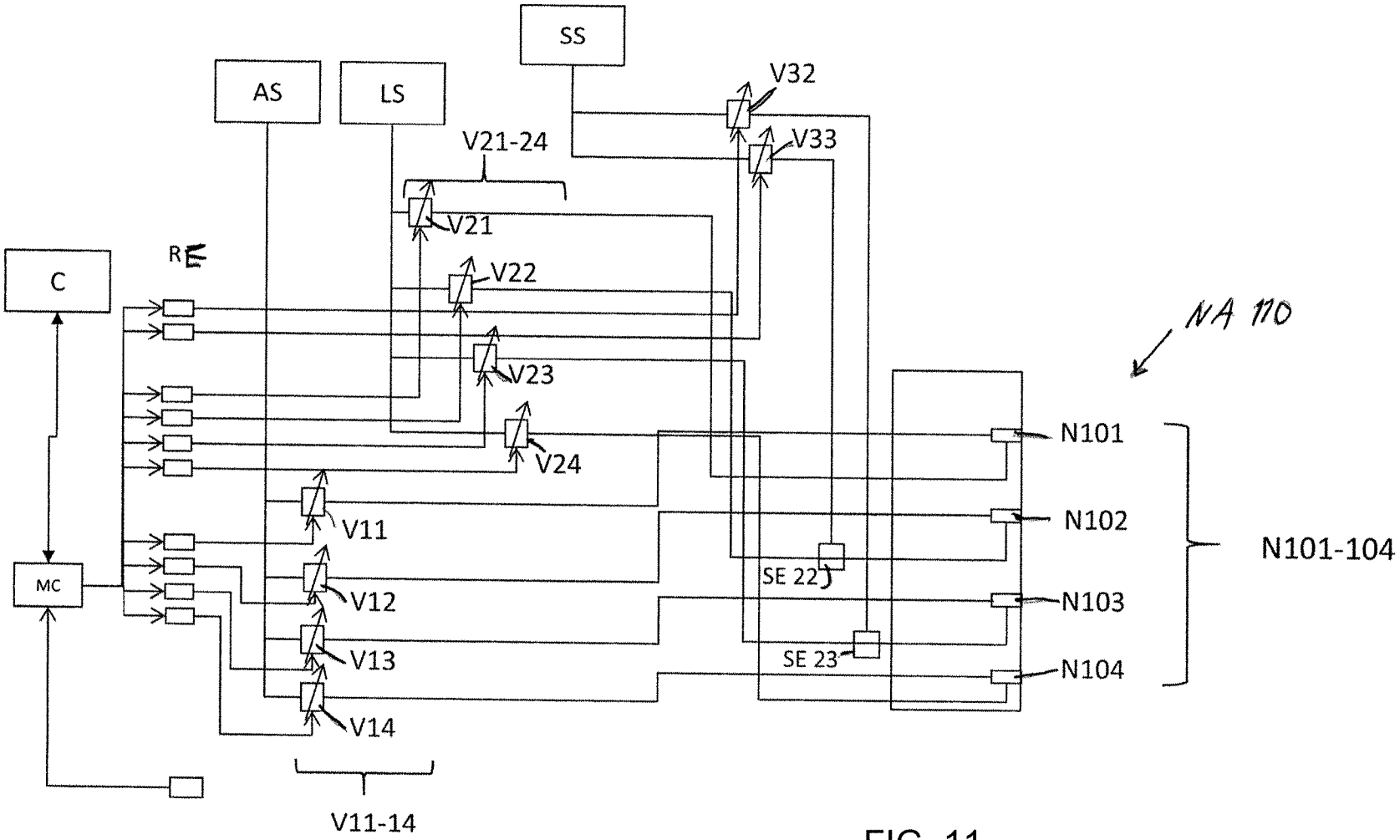
FIG. 11 shows another embodiment of the system, with one nozzle arrangement.
Figure 12:
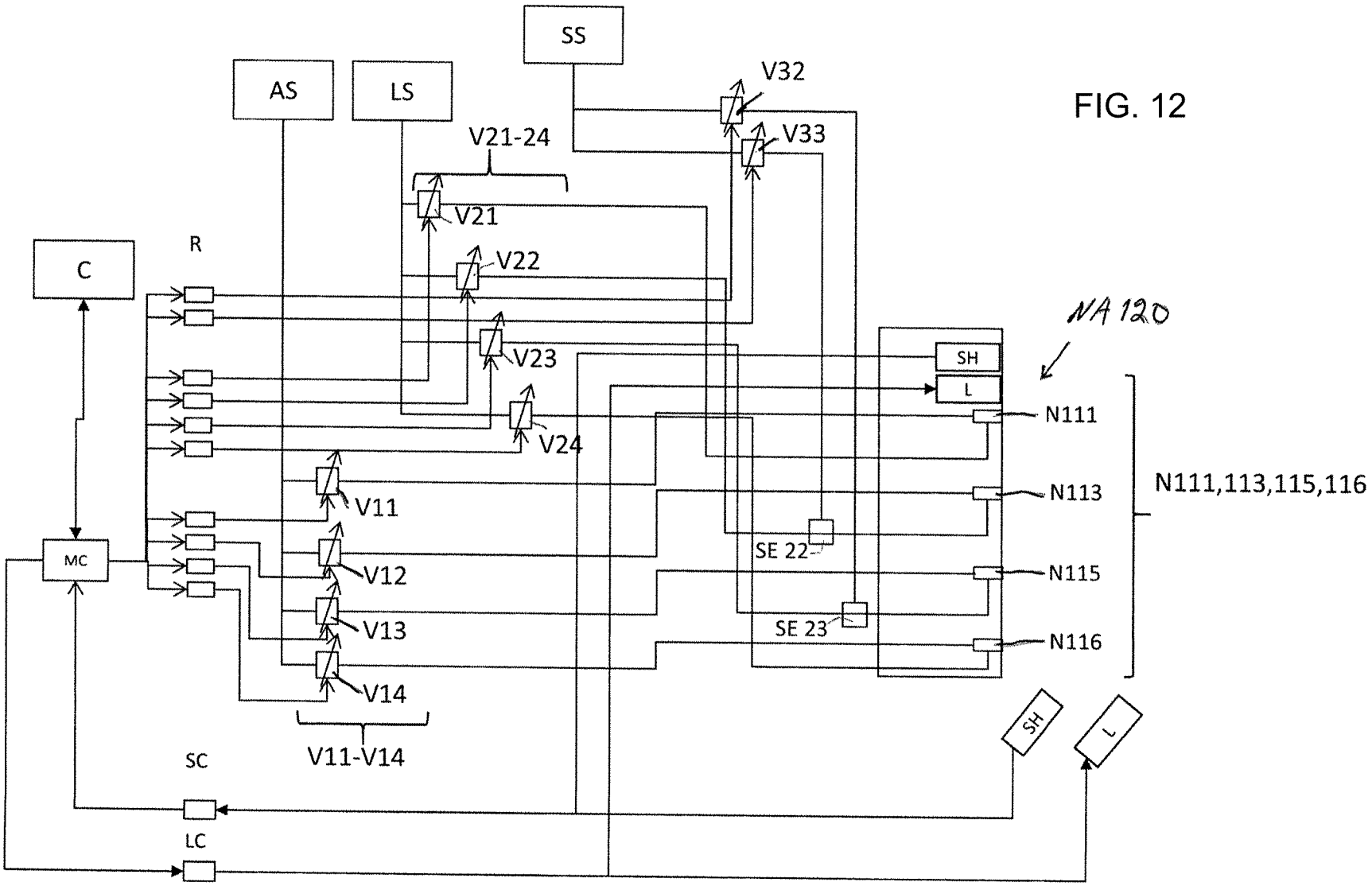
FIG. 12 shows yet another embodiment of the system with one nozzle arrangement.

Referring to FIGS. 11-12, many of the elements of FIG. 6, such as containers LS, AS, SS, relays RE, controller MC, computer C are shown in FIGS. 11-12, too. Therefore reference is made to FIG. 6.

Now, referring to system diagram of FIG. 11, especially the role of the valves is now described more closely. The nozzle arrangement NA110 comprises several such as four nozzles which can be controlled separately. The feeds in this embodiment are nozzle-specific.

Valves V11-14 are controlling the flow of pressurized from air source AS to nozzles N101-104.

Valves V21-24 are controlling the flow of first liquid (water) from liquid source LS to nozzles N101-104.

Valves V32 and V33 are controlling the flow of second liquid (soap) from source SS to nozzles N102-N103. Second liquid (soap) feed joins first liquid channels (for water) and nozzle inputs N102, N103 through sockets or other connection points SE22 and SE 23.

Regarding the type of valves, the liquid controlling valves V21-24, V32-33) can be a solenoid type liquid valve, for example Festo VODA-LD77. The pressurized air controlling valves V11-14 can be a solenoid type gas valve, for example Festo MH2 or VUVG.

In the following, the operation principle/sequence of system of FIG. 11 is as follows:

Step 1: all valves V11-14,V21-24,V32-33 are closed.

Step 2: Valves V11-14 and V21-24 are open and Valves V32 and V33 are closed: pressurized air flows out from outer opening, and draws water from the nozzles N101-N104 and forming water mist (for wetting hands).

Step 3: Valves V11-14 and V21-24 are open and Valves V32 and V33 are opened, too: Second liquid (Soap) is mixed to first liquid (water) in SE 22 and SE 23, so mist from N102 and N103 is containing second liquid (soap+water), for for spraying soap to hands. The nozzles N101 and N104 are delivering water mist.

Alternative step 3B: Valves V11 and V14 are closed, and valves V21-V24 are closed. V12 and V13 are open, and Valves V32 and V33 are opened, Now only second liquid mist (soap+air) is delivered through nozzles N102 and N103.

Alternative Step 3C: Valves V11 and V14 are closed, and valves V21 and V24 are closed. Valves V12 and V13 are open, valves V22 and V23 are open and Valves V32 and V33 are opened. Now second liquid (soap) is mixed to first liquid (water) in sockets SE22 and SE 23 and mist is delivered through nozzles N102 and N103 containing first liquid (water) and second liquid soap.

Step 4: Valves V11-14 and V21-24 are open and Valves V32 and V33 are closed: pressurized air flows out from outer opening, and draws water from the nozzles N101-N104 and forming water mist (for washing hands with soap dispensed in the previous step).

Step 5: Valves V21-24 and V32-V33 are closed, and V11-14 are open: air flows out from the opening on nozzles N101-104 without water and soap mist. This is for drying hands.

Step 6: the all valves are closed.

Now turning back to figure to FIG. 6, supported by FIGS. 1-5, System S of FIG. 6 has feeds of first liquid (water) and second liquid (soap) and pressurized air. The functional description is as follows:

The First liquid (water) is delivered through nozzles N11, N13, N15, N16). Nozzled are connected to liquid tank LS, such as water tank. Pressurized Air inputs AIN for the first liquid nozzles is connected to air source such air compressor or its air tank AS. The input of the first liquid to nozzles is controlled by a valve V1 connected to the first liquid pipe being connected to liquid source LS such as water tank. The input of pressurized air to nozzle for first liquid is controlled by a valve V2 connected to the pressurized air pipe and air tank/source AS.

Second liquid (soap) is delivered through nozzles N12, N14. The input for them input is connected to second liquid tank (SS), such as soap tank. Pressurized Air input for the second liquid nozzles is connected to air source such air compressor or its air tank AS. The input of the second liquid to nozzles is controlled by a valve V4 connected to the second liquid pipe. The input of pressurized air to nozzle for second liquid is controlled by a valve V3 connected to the pressurized air pipe.

The liquid controlling valves V1 and V4 can be a solenoid type liquid valve, for example Festo VODA-LD77. The pressurized air valves V2 and V3 can be a solenoid type gas valve, for example Festo MH2 or VUVG.

The stepwise operation in FIG. 6 is as follows:

Step 1: all valves V1,V2,V3,V4 are closed.

Step 2: Valves V1 and V2 are open and Valves V3 and V4 are closed: pressurized air flows out from air exit mouths AINM of nozzles and draws water from the nozzles N11, N13, N15, N16 and it is forming water mist, for wetting hands.

Step 3: Valves V1 and V2 are closed and Valves V3 and V4 are opened: air flows out from the opening N12 and N14 forming soap mist, for spraying soap to hands.

Step 4: Valves V1 and V2 are open and Valves V3 and V4 are closed: pressurized air flows out from outer opening, and draws water from the nozzles N11, N13, N15, N16 and it is forming water mist, for washing hands with soap dispensed in the previous step.

Step 5: Valves V1 and V4 are closed, Valve V2 is opened: air flows out from the opening on nozzles N11, N13, N15, N16. without water and soap mist. (for drying hands). Valve 3 can be opened at the same time to enhance air flow through N12 and N14.

Step 6: the all valves V1-V4 are closed.

In an embodiment, the same air flow is first used for forming liquid mist and when closing liquid output with valve V1, air is used for drying purpose.

In an embodiment, now referring to FIG. 12, each nozzle is controlled separately as described above. Now different nozzles of nozzle arrangement NA120 are operating at different times i.e. some of them are for example delayed. For example in Step 4 (washing phase) nozzles N111 and N116 are arranged to deliver mist for 2 seconds, then N113 and N115 are arranged to deliver mist for following 2 seconds, and then again N111 and N116 are delivering mist the following 2 seconds and then N113 and N115 the following 2 seconds so that total washing time is 20 seconds. This will cause a pulsing effect to deliver water to hands and will enhance washing operation.

In step 5, during the drying phase, the nozzles can be delivering air. For example first N116 for 1 second, then N115 for 1 second, Then N113 for 1 second, and N111 for 1 second, and then again N116 for one second, N115 1 second, and so on so that whole drying time is 16 seconds.

Alternatively, all nozzles are delivering air so that valves V11-14 are all open, and when liquid related valves V21-24, and V32-33 are closed.

Now each nozzle N116, N115, N113, N111 are closed in series while other are still open. First V11 controlling air for N111 is closed for 1 second (other V11-13 are open), then V12 controlling air for N113 is closed for 1 second (other V11, V13-14 are open), then V13 controlling air for N115 is closed for 1 second (other V11-12, V14 are open), then V14 controlling air for N116 is closed for 1 second (other V11-V13 are open), then again V11 controlling air for N111 is closed for 1 second (other V11-13 are open), and so on that whole drying time is 16 seconds.

In an embodiment, each step can be visualized by light indicators in the panel at the nozzle arrangement or by directing a colored light towards to mist cones MI or mist space. Mist will reflect and scatter the directed light so that the user can recognize it. Marked with L, a multicolor LED (RGB) can be used for lighting. Also separate different LEDs with different color can be used. The LED can be placed on the arrangement of nozzles, or washing stand frame FR of FIG. 8. Different kind of selected color can be used to illuminate washing phases. For example green for step 1 (ready for operation), yellow for step 2 (wetting hands), green for step 3 (soaping hands), blue for step 4 (washing hands) and green for step 5 (drying hands). Lights can be controlled by a light control unit LC (in FIG. which controlled by microcontroller MC. Therefore, washing sequence is illuminated with different colors.

Regarding operation of sensor, such as sensors SE2, SE3 in FIG. 6 and sensors SH in FIG. 12. A proximity sensor like SH can be used for detecting when hands are put in close to nozzles or in the washing area/space. The proximity sensor such IR reflection sensor or ultrasonic sensor used in mobile smartphones can used. The sensor SH detects when a hand is close and microcontroller MC can start washing sequence and washing operation. If a hand is removed from the washing space, the microcontroller MC can stop the washing sequence. Sensor controller SC is between the sensor SH and the microcontroller MC.

Regarding operation, washing sequence uses synchronized and serially open/closed valves which control nozzles: N11, N13, N15,N16 that are in a in-line formation in FIG. 6. or nozzles N111, 113,115,116 that are in in-line-formation in FIG. 12.

Regarding FIG. 6, washing sequence uses synchronized and serially open/closed valves which control the lines/arrangements of nozzles NA1, NA2 NA3.

Figure 8:
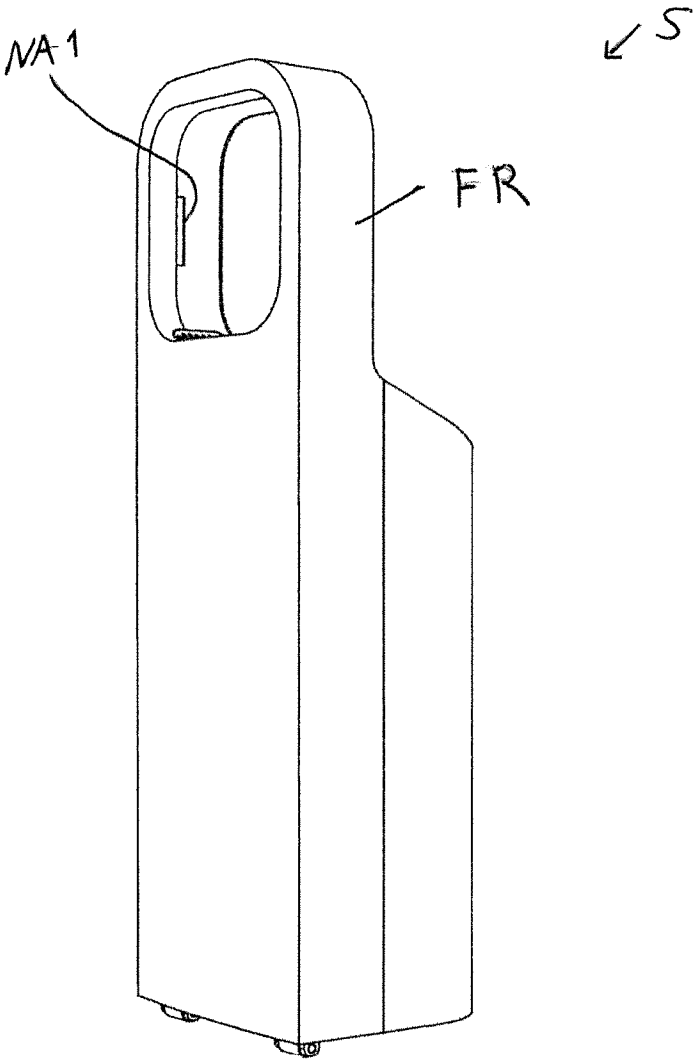
FIG. 8 shows the appearance of a mobile liquid distribution system/station.

Regarding system S as a mobile unit, as disclosed in FIGS. 7-8, the mobile unit contained in frame FR can be moved when air interface and liquid interface connectors are disconnected. Preferably using quick couplers are used as connectors, for example Premium Plus Safety Coupling, Parker Hannifin Corp, Cleveland, Ohio or Watts' Quick-connector, Watts Water Technologies Inc.

Depending on the integration level of the system S, alternatively mobile unit can be moved when air interface connector is disconnected. Preferably using a quick coupler.

It will be obvious to a person skilled in the art that, as the technology advances, the inventive concept can be implemented in various ways. The invention and its embodiments are not limited to the examples described above but may vary within the scope of the claims.

The invention claimed is:

1. A nozzle, comprising:

a liquid inlet channel (LIN) for liquid, the liquid inlet channel having a liquid exit mouth (LINM) for letting liquid out from the liquid inlet channel, a pressurized gas inlet channel (AIN) having a gas exit mouth (AINM) for letting pressurized gas out from the pressurized gas inlet channel (AIN), wherein the liquid inlet channel (LIN) is a non-pressurized liquid inlet channel (LIN), and the non-pressurized liquid inlet channel (LIN) and the pressurized gas inlet channel (AIN) are positioned in such way that the pressurized gas inlet channel (AIN) at least partially surrounds the non-pressurized liquid inlet channel (LIN) so as to create mist from non-pressurized liquid exiting from the liquid exit mouth (LINM) and pressurized gas exiting from the gas exit mouth (AINM);

wherein the nozzle is a washing nozzle, and, wherein the nozzle is a monolithic piece.

2. The nozzle of claim 1, wherein the liquid inlet channel (LIN) is coaxial with the pressurized gas inlet channel (AIN).

3. The nozzle of claim 1, wherein the liquid inlet channel is positioned in such way that at least at the exit mouths (LINM, AINM) of the liquid inlet channel (LIN) and the pressurized gas inlet channel (AIN), the liquid inlet channel shares the same central point with the pressurized gas inlet channel (AIN).

4. The nozzle of any of claim 1, wherein the exit mouth (LINM) of the liquid inlet channel (LIN) and the exit mouth (AINM) of the pressurized gas inlet channel (AIN) extend in such way that they are substantially in a same plane.

5. The nozzle of claim 1, wherein the transversal cross-sectional area of a flow space within the liquid inlet channel (LIN) is less than 75% of the transversal cross-sectional area of the flow space within the pressurized gas inlet channel (AIN).

6. The nozzle of claim 1, wherein at the exit mouth (LINM) of the liquid inlet channel (LIN), the transversal cross-sectional area of a flow space within the liquid inlet channel (LIN) is less than 75% of the transversal cross-sectional area of the flow space within the pressurized gas inlet channel (AIN), at the exit mouth (AINM) of the pressurized gas inlet channel (AIN).

7. The nozzle of claim 1, wherein the thickness of a wall (WL) of the liquid inlet channel (LIN) is less than 0.30 mm.

8. The nozzle of claim 1, wherein the nozzle (N, N1-N4) is a nozzle of a water tap.

9. The nozzle of claim 1, wherein the nozzle (N, N1-N4) is a 3D-printed piece.

10. A nozzle arrangement, comprising two or more nozzles, where a nozzle comprises:

a liquid inlet channel (LIN) for liquid, the liquid inlet channel having a liquid exit mouth (LINM) for letting liquid out from the liquid inlet channel, a pressurized gas inlet channel (AIN) having a gas exit mouth (AINM) for letting pressurized gas out from the pressurized gas inlet channel (AIN), wherein the liquid inlet channel (LIN) is a non-pressurized liquid inlet channel (LIN), and the non-pressurized liquid inlet channel (LIN) and pressurized gas inlet channel (AIN) are positioned in such a way that the pressurized gas inlet channel (AIN) at least partially surrounds the non-pressurized liquid inlet channel (LIN) so as to create mist from non-pressurized liquid exiting from the liquid exit mouth (LINM) and pressurized gas exiting from the gas exit mouth (AINM);

wherein the nozzle is a washing nozzle, and, wherein the nozzle is a monolithic piece.

11. The nozzle arrangement of claim 10, wherein the two or more nozzles are in a line formation forming a washing line having mist outputs.

12. The nozzle arrangement of claim 10, wherein the two or more nozzles are in a multiple line formation comprising at least two lines of nozzles, for forming a washing space of mist output.

13. The nozzle arrangement of claim 10, wherein the arrangement comprises at least three lines of nozzles, and those lines of nozzles are directed to a common center point forming a washing space around the center point.

14. A liquid distribution system, comprising a liquid source (LS) or an interface for connecting to a liquid source, and a source (AS) of pressurized gas or an interface for connecting to a source of pressurized gas, wherein the system comprises one or more nozzles (N, N1-N4, N11-N16), wherein the one or more nozzles comprises:

a liquid inlet channel (LIN) for liquid, the liquid inlet channel having a liquid exit mouth (LINM) for letting liquid out from the liquid inlet channel, a pressurized gas inlet channel (AIN) having a gas exit mouth (AINM) for letting pressurized gas out from the pressurized gas inlet channel (AIN), wherein the liquid inlet channel (LIN) is a non-pressurized liquid inlet channel (LIN), and the non-pressurized liquid inlet channel (LIN) and pressurized gas inlet channel (AIN) are positioned in such way that the pressurized gas inlet channel (AIN) at least partially surrounds the non-pressurized liquid inlet channel (LIN) so as to create mist from non-pressurized liquid exiting from the liquid exit mouth (LINM) and pressurized gas exiting from the gas exit mouth (AINM), and wherein the liquid feed is connected to liquid inlet channel (LIN) and wherein the feed of pressurized gas is connected to pressurized gas inlet channel (AIN);

wherein the nozzle is a washing nozzle, and, wherein the nozzle is a monolithic piece.

15. The liquid distribution system of claim 14, further comprising a waste liquid container (WLC) for receiving water droplets or condensing water.

16. The liquid distribution system of claim 15, wherein the liquid distribution system contains said waste liquid container, but the inputting of liquid and pressurized gas to nozzles is arranged via said interfaces for liquid and gas.

17. The liquid distribution system of claim 15, wherein the liquid distribution system contains said waste liquid container (WLS) and said liquid source (LS) but the inputting of pressurized gas to nozzles is arranged via said interface for gas.

18. The liquid distribution system of claim 15, wherein the liquid distribution system is an independent mobile unit, containing said liquid source (LS) and said source (AS) of pressurized gas and said waste liquid container (WLC).

19. The liquid distribution system of claim 14, wherein the system further comprises controller (V1) to close the flow of the liquid inlet channel (LIN), so as to stop the creation of mist and so as to replace the mist with a drying gas flow.

* * * * *